US007658481B2

(12) United States Patent
Hiratsuka et al.

(10) Patent No.: US 7,658,481 B2
(45) Date of Patent: Feb. 9, 2010

(54) DROPLET DISCHARGE APPARATUS

(75) Inventors: Masashi Hiratsuka, Ebina (JP); Kishiharu Itazu, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 335 days.

(21) Appl. No.: 11/592,601

(22) Filed: Nov. 3, 2006

(65) Prior Publication Data

US 2007/0279461 A1 Dec. 6, 2007

(30) Foreign Application Priority Data

Jun. 5, 2006 (JP) ..... 2006-156113

(51) Int. Cl.
*B41J 2/175* (2006.01)

(52) U.S. Cl. ..... 347/85

(58) Field of Classification Search ..... 347/84, 347/85

See application file for complete search history.

(56) References Cited

U.S. PATENT DOCUMENTS

2005/0104943 A1 5/2005 Hida

FOREIGN PATENT DOCUMENTS

JP 2005-144954 6/2005

*Primary Examiner*—An H Do
(74) *Attorney, Agent, or Firm*—Fildes & Outland, P.C.

(57) ABSTRACT

A droplet discharge apparatus includes a droplet discharge head which discharges droplets; a liquid retention unit which is configured such that a liquid surface of a liquid retained in the liquid retention unit is located below the droplet discharge head, the liquid retention unit including an atmosphere open port; a liquid channel which couples the droplet discharge head and the liquid retention unit; a liquid tank in which the liquid is retained, the liquid tank being sealed; a liquid inflow channel which couples the liquid retention unit and the liquid tank, an inflow port of the liquid inflow channel in the liquid retention unit being located below the atmosphere open port; a liquid sending channel which couples the liquid tank and the droplet discharge head; and a pump which sending the liquid in the liquid tank to the droplet discharge head.

9 Claims, 13 Drawing Sheets

DROPLET DISCHARGE APPARATUS

BACKGROUND

1. Technical Field

The present invention relates to a droplet discharge apparatus which discharges droplets.

2. Related Art

In the droplet discharge apparatus such as an inkjet recording apparatus, bubbles in a droplet discharge head or a liquid channel cause discharge failure and an increase in channel resistance. Therefore, conventionally liquid is circulated between the droplet discharge head and a liquid tank opened to atmosphere, bubbles are recovered to the liquid tank or to a sub-liquid tank coupled to the liquid tank, and the bubbles are discharged to the atmosphere from the liquid tank or the sub-liquid tank.

SUMMARY

A droplet discharge apparatus according to one aspect of the invention is a droplet discharge apparatus including: a droplet discharge head that discharges droplets; a liquid retention unit that is provided below the droplet discharge head, the liquid retention unit including an atmosphere open port; a liquid channel that couples the droplet discharge head and the liquid retention unit; a liquid tank that retains liquid therein, the liquid tank being sealed; a liquid inflow channel that couples the liquid retention unit and the liquid tank, an inflow port of the liquid inflow channel in the liquid retention unit being located below the atmosphere open port; a liquid sending channel that couples the liquid tank and the droplet discharge head; and a pump that is provided at the liquid sending channel, the pump sending the liquid in the liquid tank to the droplet discharge head.

BRIEF DESCRIPTION OF THE DRAWINGS

Exemplary embodiments of the present invention will be described in detail based on the following figures, wherein.

DETAILED DESCRIPTION

A first exemplary embodiment of the invention will be described below with reference to the drawings.

Figure 1:
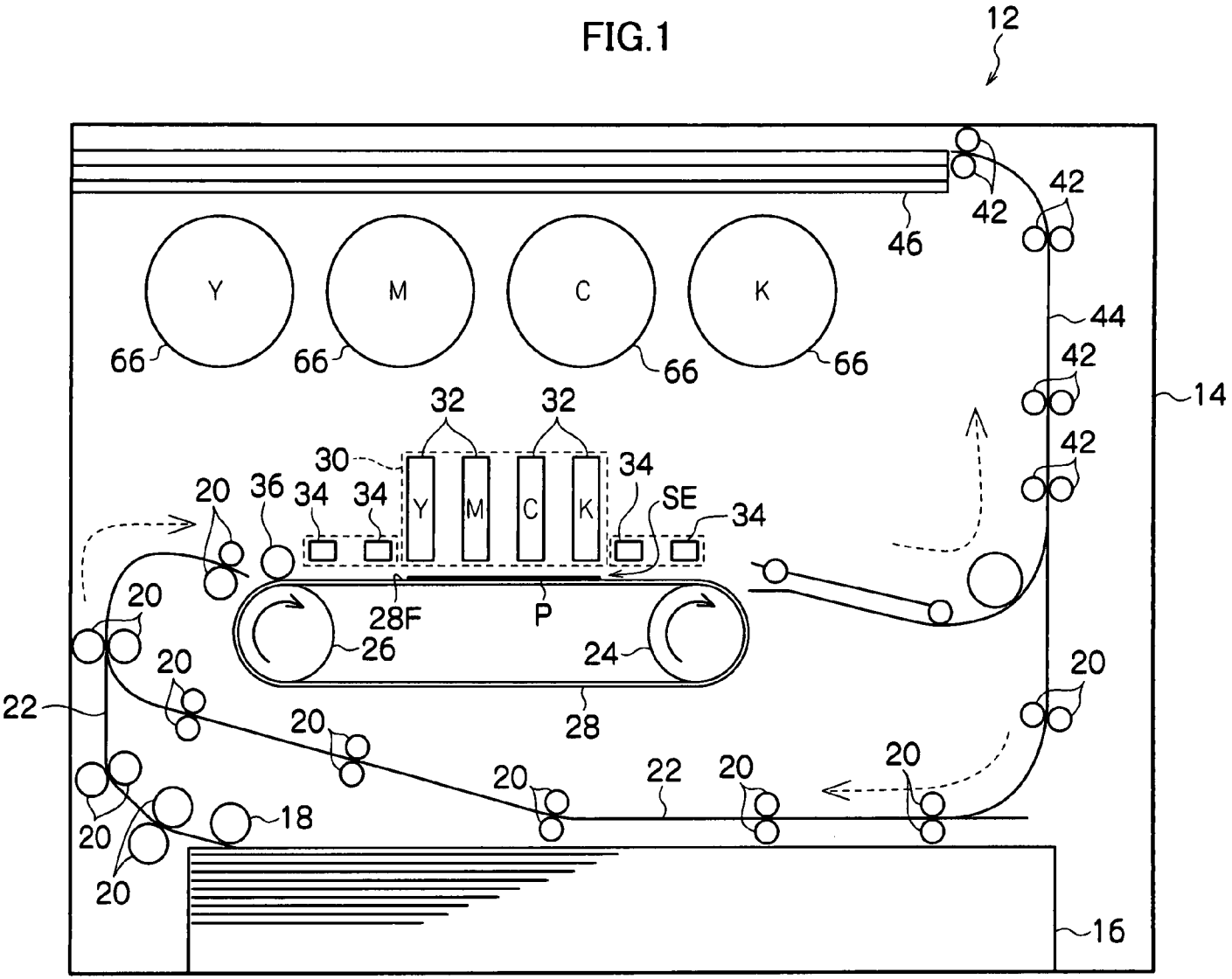
FIG. 1 is a schematic view showing an inkjet recording apparatus according to a first exemplary embodiment of the invention.

FIG. 1 shows an inkjet recording apparatus 12 according to the first exemplary embodiment. A sheet feed tray 16 is provided in a lower portion of a chassis 14 of the inkjet recording apparatus 12, and sheets P stacked in the sheet feed tray 16 can be drawn one by one by a pickup roller 18. The drawn sheet P is conveyed by plural pairs of conveyance rollers 20 constituting a predetermined conveyance path 22.

An endless conveyance belt 28 is arranged above the sheet feed tray 16, and the conveyance belt 28 is tensioned between a driving roller 24 and a driven roller 26. A recording head array 30 is arranged above the conveyance belt 28, and the recording head array 30 faces a flat portion 28F of the conveyance belt 28. The area where the recording head array 30 faces a flat portion 28F becomes a discharge area SE where the ink droplet is discharged from the recording head array 30. The sheet P conveyed through the conveyance path 22 reaches the discharge area SE while retained by the conveyance belt 28, and the ink droplet is caused to adhere onto the sheet P from the recording head array 30 according to image information with the sheet P facing the recording head array 30.

In the first exemplary embodiment, the recording head array 30 is formed in a long shape in which an effective recording area is larger than a width (length in a direction orthogonal to a conveyance direction) of the sheet P. In the recording head array 30, four inkjet recording heads (hereinafter referred to as recording head) 32 corresponding to four colors of yellow (Y), magenta (M), cyan (C), and black (K) are arranged along the conveyance direction to enable a full-color image to be recorded.

A head controller 52 (see FIG. 5) controls each recording head 32. The head controller 52 determines discharge timing of the ink droplet and an ink discharge port (nozzle) to be used according to the image information, and the head controller 52 transmits a drive signal to the recording head 32.

The recording head array 30 may be fixed in the direction orthogonal to the conveyance direction. However, when the recording head array 30 is formed to be able to be moved in the direction orthogonal to the conveyance direction if needed, the image having higher resolution can be recorded or a trouble with the recording head 32 cannot be reflected on recording result by the multi-pass image recording.

Figure 2:
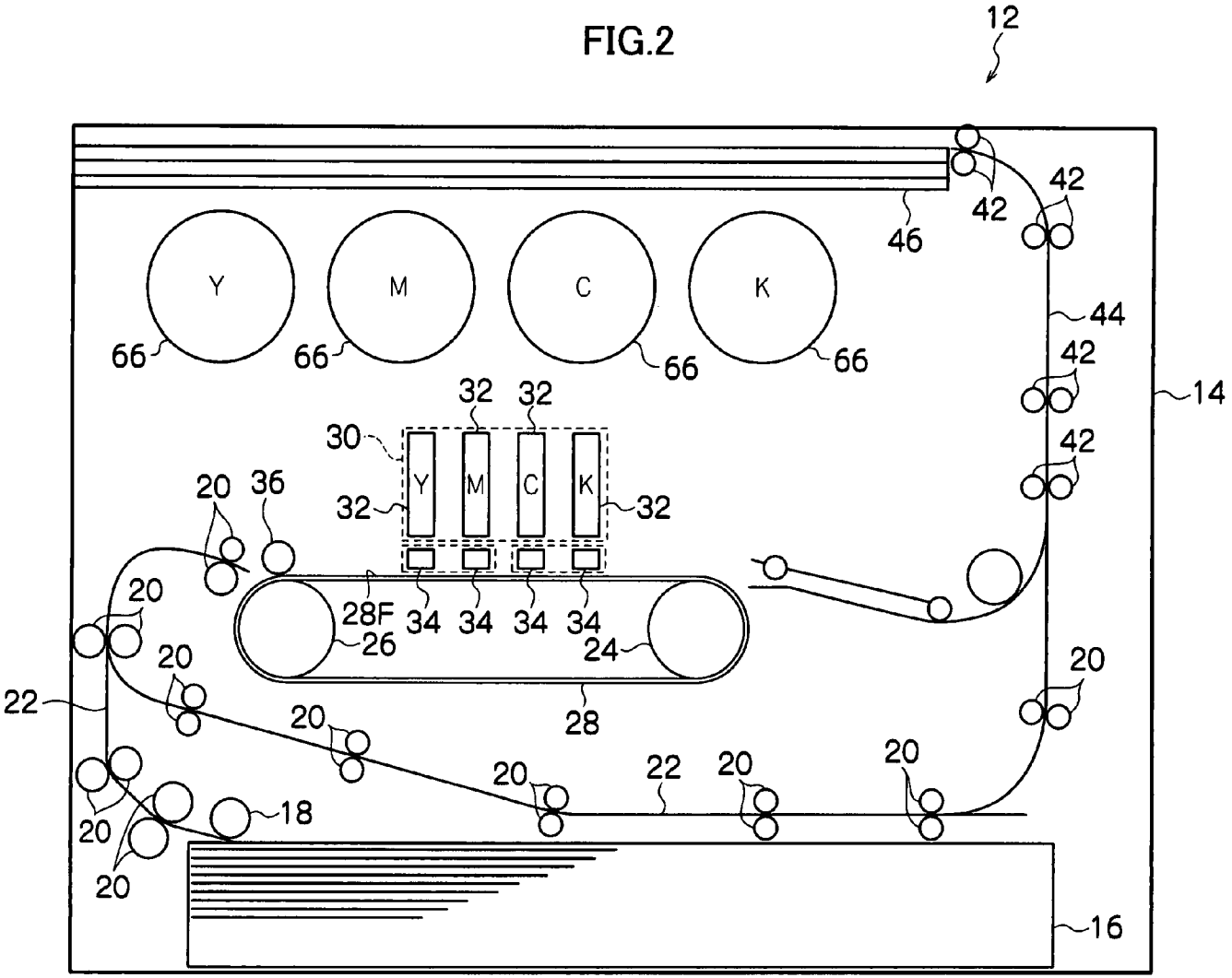
FIG. 2 is a schematic view showing the inkjet recording apparatus according to the first exemplary embodiment of the invention.

Four maintenance units 34 corresponding to the recording heads 32 are arranged on both sides of the recording head array 30. As shown in FIG. 2, in the case where maintenance is performed to the recording head 32, the recording head array 30 is moved upward, and the maintenance unit 34 is moved and intrudes into a gap formed between the conveyance belt 28 and the recording head array 30. The maintenance unit 34 performs a predetermined maintenance operation (such as suction, wiping, and capping) while facing the nozzle surface 32N (see FIG. 8).

Figure 3:
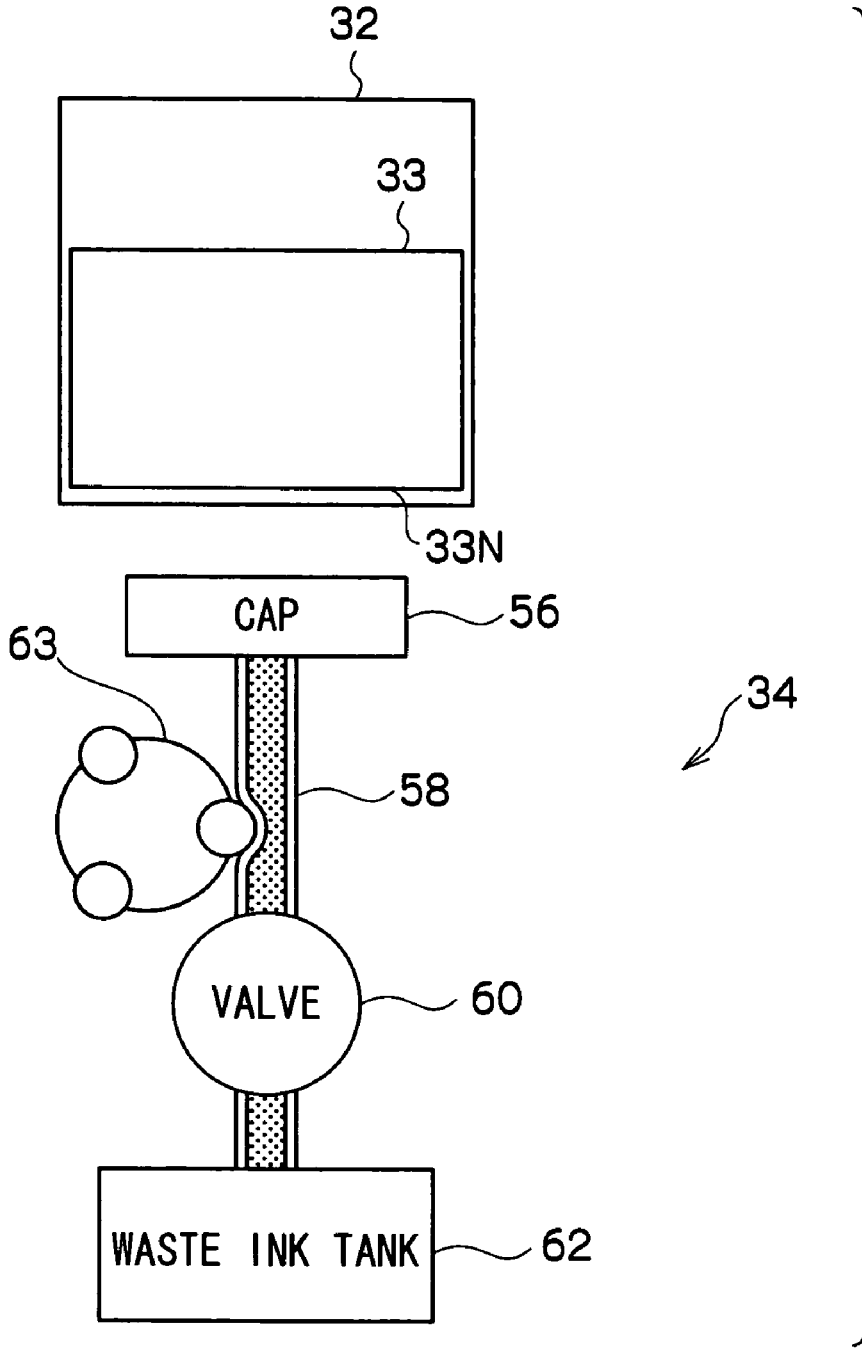
FIG. 3 is a schematic view showing a maintenance unit of the inkjet recording apparatus according to the first exemplary embodiment of the invention.

As shown in FIG. 3, the maintenance unit 34 includes a cap 56 and a drain line 58. The cap 56 receives the ink from a nozzle surface 33N in a recovery operation of the inkjet recording apparatus 12. The ink received by the cap 56 is drained through the drain line 58. A waste ink tank 62 is provided at a downstream end in the drain direction of the drain line 58 while a valve 60 is located in the middle of the drain line 58. The inkjet recording apparatus 12 also includes a pump 63 which imparts ink sending force (ink sucking force) to the cap 56. The ink sending force is one with which the ink is sent from the cap 56 to the drain line 58. The pump 63 is controlled by a controller 48 (see FIG. 5) which controls the whole of the inkjet recording apparatus 12.

In the first exemplary embodiment, the four maintenance units 34 are divided into two sets of two maintenance units 34, and the two sets are respectively arranged in the upstream side and down stream side in the conveyance direction of the recording head array 30 during the image recording.

Figure 4:
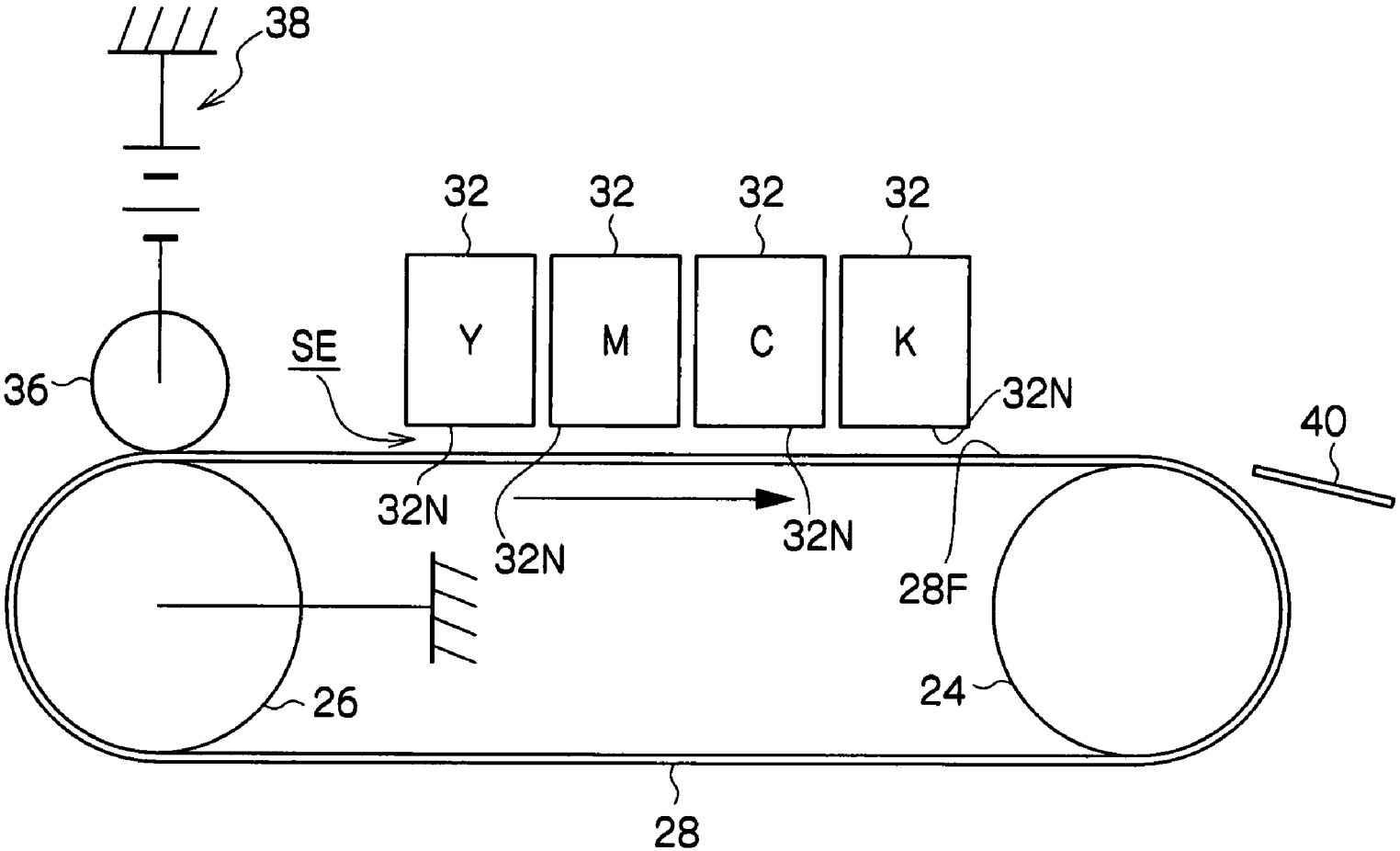
FIG. 4 is a partially schematic view showing the inkjet recording apparatus according to the first exemplary embodiment.

As shown in FIG. 4, a charging roller 36 connected to a power supply 38 is arranged on the upstream side of the recording head array 30. The charging roller 36 is driven while nipping the conveyance belt 28 and sheet P along with the driven roller 26, and the charging roller 36 is formed so as to be movable between a pressing position where the charging roller 36 presses the sheet P against the conveyance belt 28 and a distance position where the charging roller 36 is distanced from the conveyance belt 28. Because a predetermined potential difference between the charging roller 36 and the driven roller 26 is generated at the pressing position, an electric charge can be imparted to the sheet P to electrostatically suck the sheet P to the conveyance belt 28. A separation plate 40 is arranged on the downstream side of the recording head array 30, and the sheet P is separated from the conveyance belt 28 by the separation plate 40.

Figure 5:
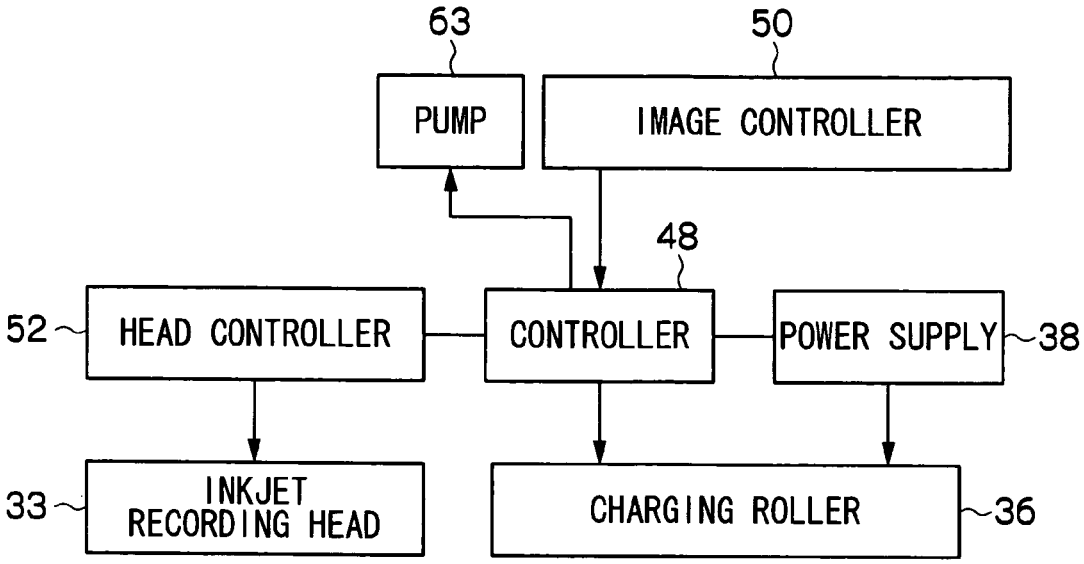
FIG. 5 is a schematic view showing an operation of the inkjet recording apparatus according to the first exemplary embodiment.

As shown in FIG. 5, the controller 48 controls the whole of the inkjet recording apparatus 12, and the controller 48 controls the operations including the feed of the sheet P, the image recording, discharge of the sheet P, and the maintenance. Various kinds of data concerning the image to be recorded are transmitted from an image controller 50 to the controller 48. A head controller 52 controls a later-mentioned inkjet recording head 32 (see FIG. 6, hereinafter referred to as recording head), and the controller 48 transmits a signal to the head controller 52. The power supply 38 supplies the electric power to the controller 48, the head controller 52, and the charging roller 36.

In the inkjet recording apparatus 12 having the above configuration, the sheet P drawn from the sheet feed tray 16 reaches the conveyance belt 28 as described above. While the sheet P is pressed against the conveyance belt 28 by the charging roller 36, the sheet P is attracted to and retained on the conveyance belt 28 by the applied voltage from the charging roller 36. In this state, the ink droplet is discharged from the recording head array 30 while the sheet P passes through the discharge area SE by the rotation of the conveyance belt 28, which allows the image to be recorded on the sheet P. Then, the sheet P is separated from the conveyance belt 28 by the separation plate 40, the sheet P is conveyed by plural pair of discharge rollers 42 constituting a discharge path 44 on the downstream side of the separation plate 40, and the sheet P is discharged to a sheet discharge tray 46 provided in an upper portion of the chassis 14.

Figure 6:
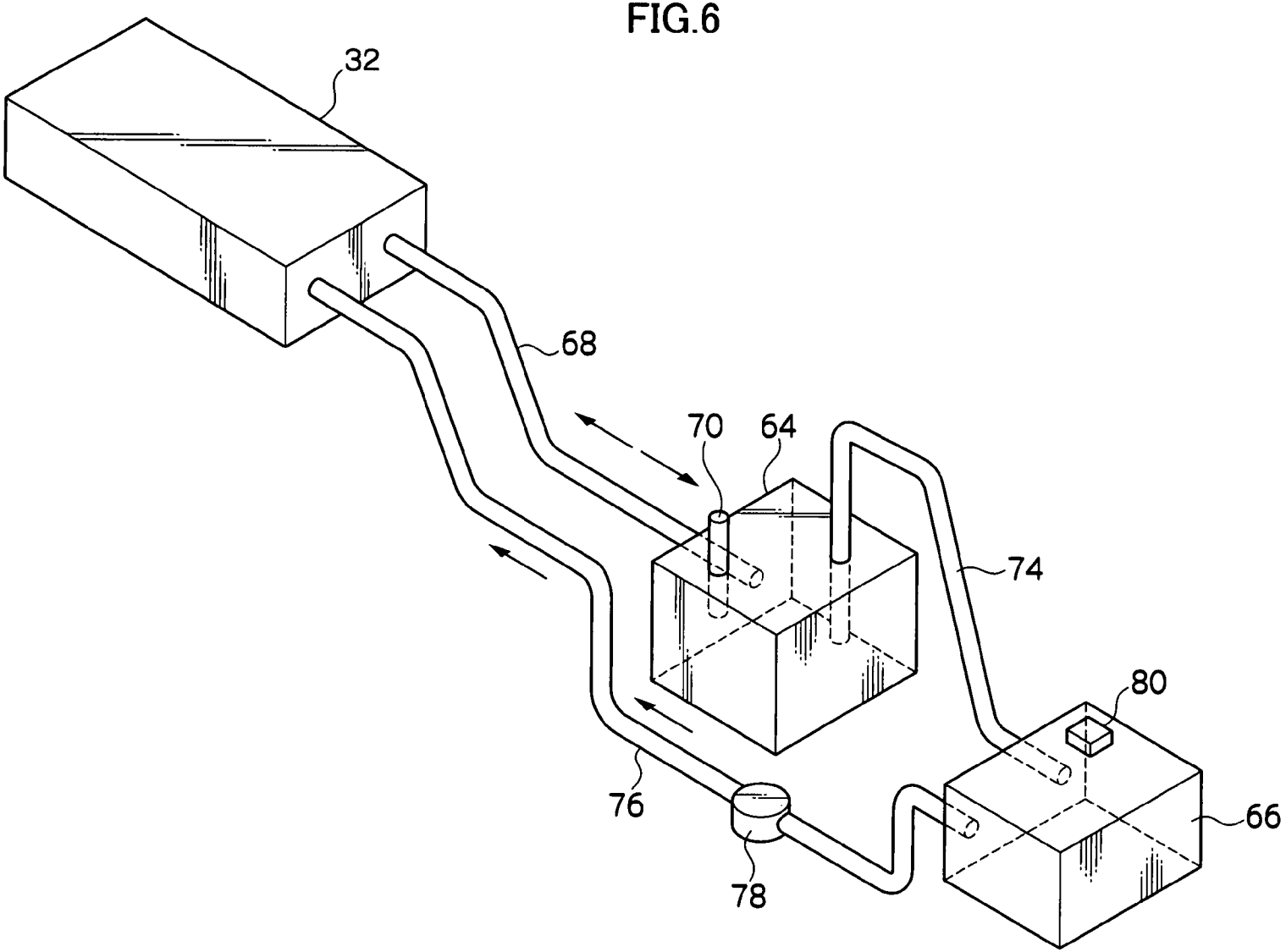
FIG. 6 is a perspective view showing a positional relationship among a main tank, a reservoir tank, and a recording head of the inkjet recording apparatus according to the first exemplary embodiment.
Figure 7:
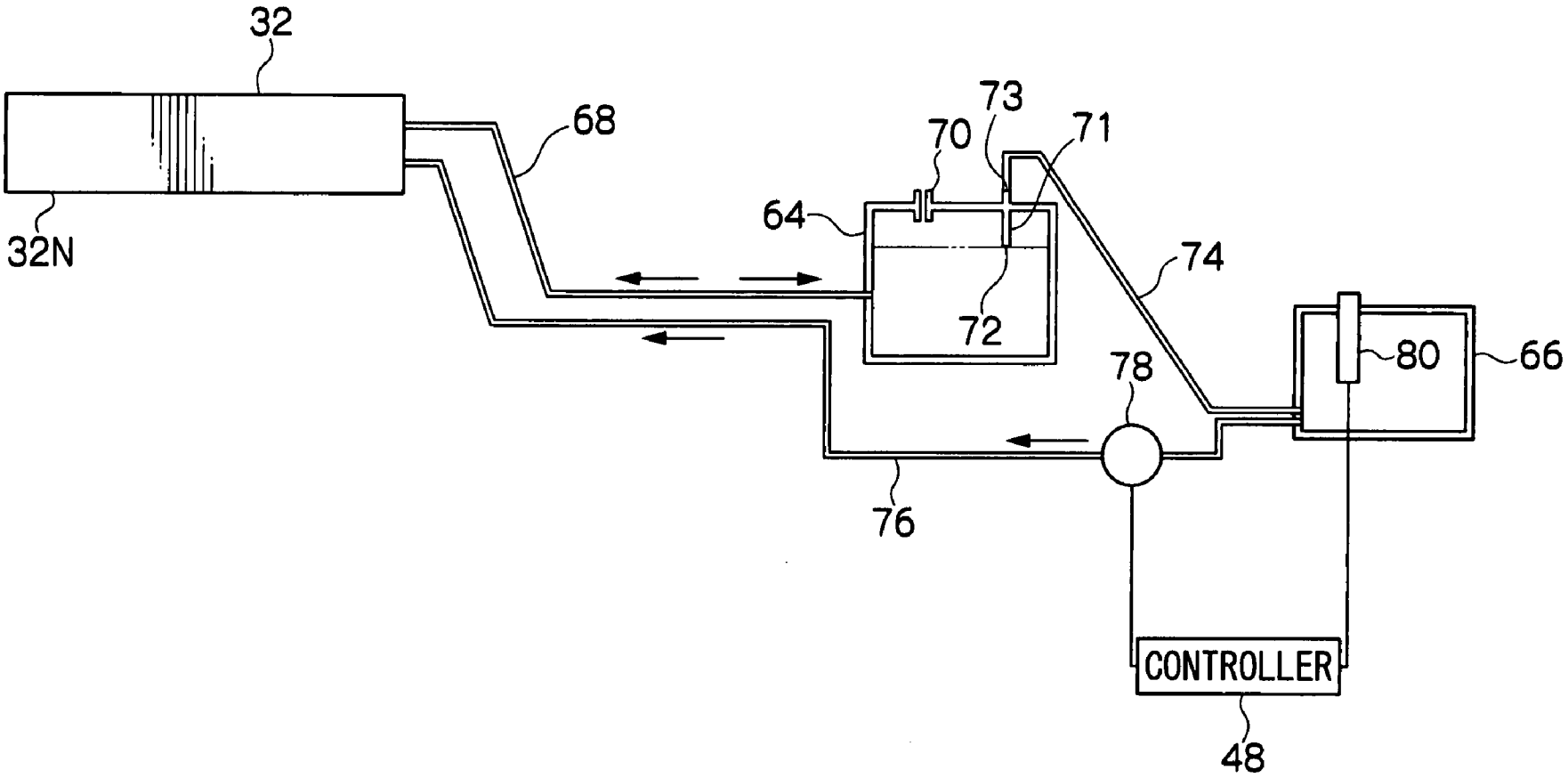
FIG. 7 is a side view showing the positional relationship among the main tank, the reservoir tank, and the recording head.

As shown in FIGS. 6 and 7, a reservoir tank 64 is arranged obliquely below the recording head 32. The recording head 32 and the reservoir tank 64 are coupled to each other with an ink channel 68, and a back pressure is generated in a channel of the recording head 32 such that the ink does not leak from the nozzle. When the ink is discharged from the nozzle of the recording head 32, the inside of the recording head 32 becomes a negative pressure and the ink is supplied from the reservoir tank 64 to the recording head 32 in the negative pressure state.

A sealed main tank 66 (ink tank) is arranged obliquely below the reservoir tank 64. The reservoir tank 64 and the main tank 66 are coupled to each other with a return channel 74 and, as described later, the reservoir tank 64 is filled with the ink from the main tank 66 as required.

Figure 8:
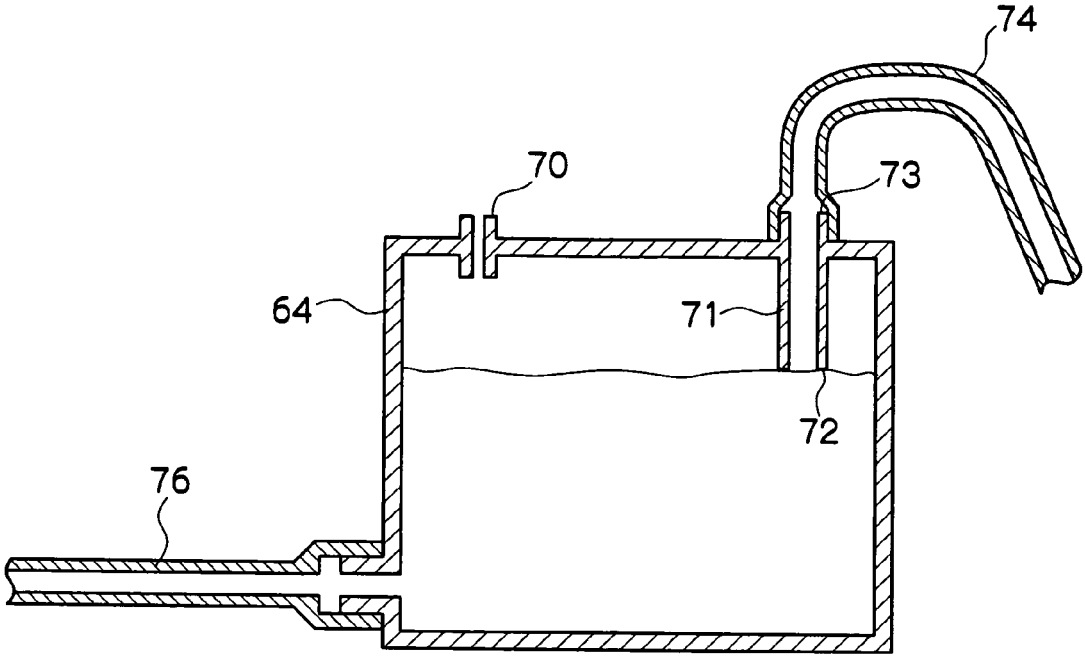
FIG. 8 is a sectional side view of the reservoir tank.

As shown in FIG. 8, an atmosphere communicating port 70 is provided in an upper wall (top wall) of the reservoir tank 64. The atmosphere communicating port 70 is always opened to atmospheric pressure, and the atmospheric pressure is applied to a liquid surface of the ink in the reservoir tank 64.

A pipe 71 pierces through the upper wall (top wall) of the reservoir tank 64. An ink inlet port 72 at one end portion of the pipe 71 is located below the atmosphere communicating port 70. A return channel 74 coupled to the main tank 66 (see FIG. 7) is attached to an outflow port 73 at the other end of the pipe 71.

Therefore, when the ink in the reservoir tank 64 rises up to the ink inlet port 72, because the main tank 66 becomes a negative pressure state as described later, the ink flows into the main tank 66 through the return channel 74.

As shown in FIGS. 6 and 7, the main tank 66 and the recording head 32 are coupled to each other with an ink channel 76. A filling pump 78 is provided in the ink channel 76, and the ink flows from the main tank 66 into the recording head 32 by driving the filling pump 78.

The main tank 66 is molded by a rigid member. Therefore, the negative pressure state is maintained while the main tank 66 is not deformed, even if the ink flows out from the sealed main tank 66 to generate the negative pressure inside the main tank 66.

An optical sensor 80 which is of ink amount detection means is provided in the main tank 66. The optical sensor 80 includes a light emitting device (not shown) and a light acceptance device (not shown). When the liquid surface of the ink rises above the optical sensor 80, light emitted from the light emitting device is blocked by the ink and the light is not received by the light acceptance device.

Therefore, a liquid surface level of the ink is detected in the main tank 66 by the optical sensor 80. When ink runout is detected in the main tank 66, the ink runout is displayed on a display panel (not shown) of the inkjet recording apparatus 12 (see FIG. 1) through the controller 48 connected to the optical sensor 80, and a user is encouraged to exchange the main tanks 66.

Figure 9:
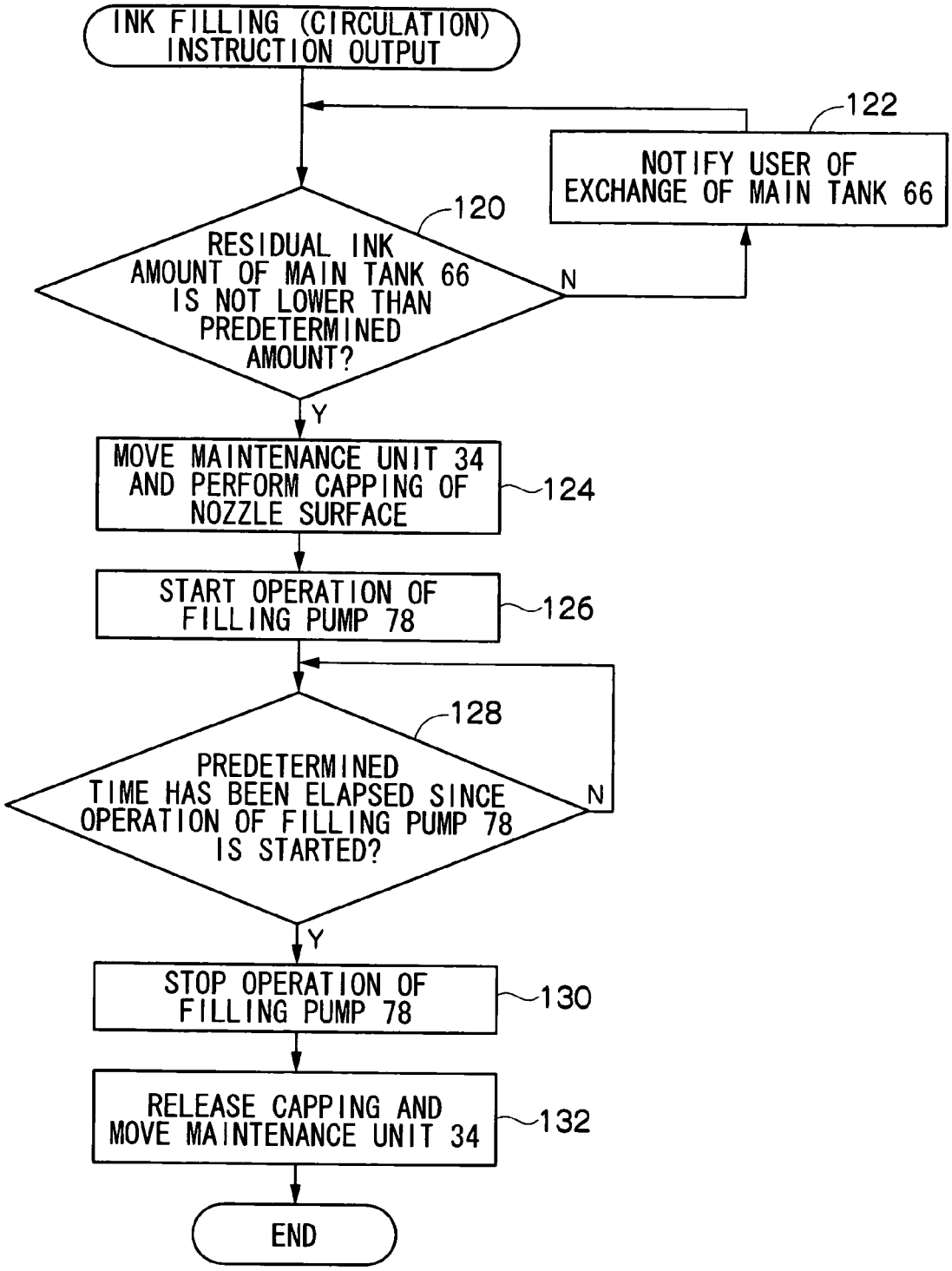
FIG. 9 is a flowchart showing operations of ink filling and ink circulation.

A method of filling the reservoir tank 64 with the ink from the main tank 66 and a method of circulating the ink among the main tank 66, the reservoir tank 64, and the recording head 32 will be described with reference to a flow chart of FIG. 9.

When an instruction for filling the reservoir tank 64 with the ink from the main tank 66 or an instruction for circulating the ink among the main tank 66, the reservoir tank 64, and the recording head 32 is outputted, the optical sensor 80 detects the liquid surface level of the ink in the main tank 66 in Step 120.

When a residual ink amount in the main tank 66 is lower than a predetermined amount, the flow goes to Step 122, and the ink runout is displayed on the display panel (not shown) of the inkjet recording apparatus 12. Therefore, a user is notified of the ink runout in the main tank 66 and the user exchanges the main tanks 66.

On the other hand, in Step 120, when the residual ink amount in the main tank 66 is not lower than the predetermined amount, the flow goes to Step 124. In Step 124, the maintenance unit 34 (see FIG. 1) is moved beneath the recording head 32 to perform the capping of the nozzle surface.

In Step 126, the drive operation of the filling pump 78 is started to cause the ink in the main tank 66 to flow into the reservoir tank 64 through the ink channel 76, the recording head 32, and the ink channel 68.

At this point, when the liquid surface of the ink flowing into the reservoir tank 64 reaches the ink inlet port 72, the ink flows into the main tank 66 from the reservoir tank 64 through the return channel 74.

In Step 128, it is determined whether or not a predetermined time elapses since the drive operation of the filling pump 78 is started. For example, in the ink filling, it is determined whether or not a time necessary to fill the reservoir tank 64 with a predetermined amount of ink elapses. For example, in the ink circulation, it is determined whether or not a time necessary to circulate the ink among the reservoir tank 64, the main tank 66, and the recording head 32 elapses.

The ink circulation among the reservoir tank 64, the main tank 66, and the recording head 32 transports the bubble (gas dissolved in the ink and the bubble generated from a component having permeability to the gas) generated in the recording head 32 to the reservoir tank 64, and the bubble is exhausted from the atmosphere communicating port 70 into the atmosphere. Because the ink circulation stirs the ink, settling of pigment can also be prevented.

When the predetermined time elapses since the drive operation of the filling pump 78 is started, the flow goes to Step 130, and the drive operation of the filling pump 78 is stopped. In Step 132, the capping of the nozzle surface is released to retract the maintenance unit 34 from beneath the recording head 32, and the operation of the ink filling or ink circulation is ended.

The residual ink amount in the reservoir tank 64 is estimated from print information. That is, the ink amount discharged from the nozzle of the reservoir tank 64 is computed by summing the number of pixels of the print, and thereby the residual ink amount in the reservoir tank 64 is computed. The operation in which the reservoir tank 64 is filled with the ink from the main tank 66 is started when it is determined that residual ink amount in the reservoir tank 64 is lower than the predetermined amount (for example, the ink amount necessary for the print of one sheet).

Not only the residual ink amount in the reservoir tank 64 is estimated from the print information, but also the residual ink amount may be detected by a sensor provided in the reservoir tank 64. Because the reservoir tank 64 is sufficiently filled with ink by the ink circulation, the operation in which the reservoir tank 64 is filled with the ink from the main tank 66 is not generated in the case of the small print amount.

The ink circulation is performed at predetermined intervals irrespective of print frequency. For example, the ink circulation timing is performed, when the power of the inkjet recording apparatus 12 is turned on, when a standby state is released, or when a predetermined time elapses since the previous ink circulation (or ink filling) is performed.

Then, the operation of the inkjet recording apparatus 12 during the ink discharge will be described.

During the ink discharge, the operation of the filling pump 78 is stopped, so that the ink does not flow into the recording head 32 from the main tank 66 through the ink channel 76. Therefore, when the ink discharged from the nozzle of the recording head 32, the negative pressure is generated in the recording head 32, and the ink in the reservoir tank 64 is supplied through the ink channel 68 to the recording head 32 which is in the negative pressure state.

The negative back pressure is applied to the ink supplied to the recording head 32 by a water head difference between the recording head 32 and the reservoir tank 64 communicated with the atmosphere, which allows a meniscus suitable to the print to be formed in the nozzle.

Then, action of the first exemplary embodiment of the invention will be described.

When the filling pump 78 is driven to fill the reservoir tank 64 with the ink, the ink flows into the recording head 32 from the main tank 66 through the ink channel 76. The ink flowing into the recording head 32 flows into the reservoir tank 64, and the reservoir tank 64 is filled with the ink.

That is, when the filling pump 78 is driven to send the ink from the main tank 66 to the recording head 32, the ink in the main tank 66 flows into the recording head 32, the ink is supplied to the reservoir tank 64, and the reservoir tank 64 is filled with the ink.

When the liquid surface of the ink with which the reservoir tank 64 is filled reaches the ink inlet port 72 of the pipe 71 coupled to the return channel 74, the ink is sucked into the main tank 66 which is in the negative pressure state. That is, the ink is circulated among the recording head 32, the reservoir tank 64, and the main tank 66.

On the other hand, when the ink is discharged from the recording head 32, the negative pressure is generated in the recording head 32, and the ink in the reservoir tank 64 is supplied to the recording head 32 which is in the negative pressure state.

Thus, the ink filling and the ink circulation can be performed by driving the one filling pump 78. Because it is not necessary that an airtight state be generated in the reservoir tank 64 when the ink is discharged from the recording head 32, it is not necessary to provide an on-off valve which opens and closes the reservoir tank 64 to and from the atmospheric pressure. Accordingly, the whole configuration of the apparatus becomes simple to lead to the cost reduction.

The filling pump 78 is provided in the ink channel 76 which couples the main tank 66 and the recording head 32. That is, in the ink circulation and ink filling, the filling pump 78 is provided on the downstream side in the ink flowing direction of the main tank 66. Therefore, the ink flows out from the main tank 66 to generate the negative pressure in the main tank 66 by the operation of the filling pump 78. However, the breakage of the main tank 66 is never generated because the main tank 66 is not pressurized. As described above, the main tank 66 is formed by the rigid member such that the main tank 66 is not broken even if the main tank 66 becomes the negative pressure state.

In the first exemplary embodiment, the main tank 66 is arranged below the reservoir tank 64. However, because the negative pressure is generated in the main tank 66 when the filling pump 78 is driven, the main tank 66 is not always arranged below the reservoir tank 64, but the main tank 66 may be provided above the reservoir tank 64.

An inkjet recording apparatus according to a second exemplary embodiment of the invention will be described below. The description of the same component as the first exemplary embodiment will be omitted.

Figure 10:
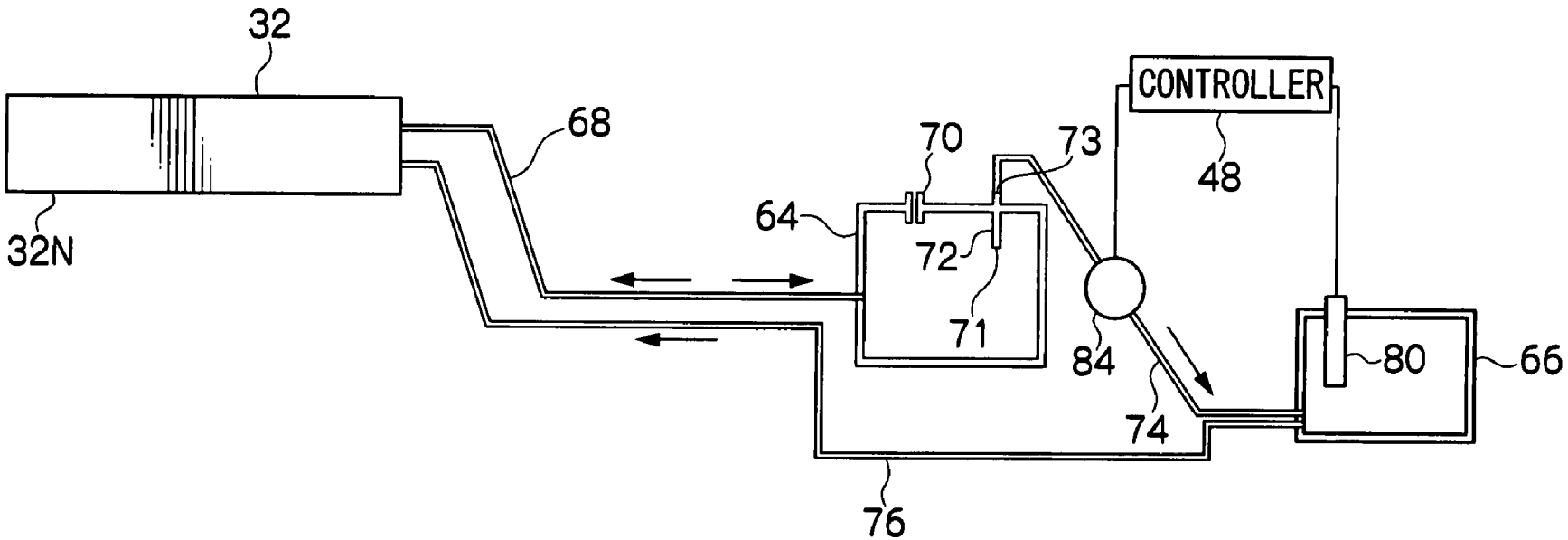
FIG. 10 is a side view showing a positional relationship among the main tank, the reservoir tank, and the recording head of an inkjet recording apparatus according to a second exemplary embodiment.

As shown in FIG. 10, a filling pump 84 is provided in the return channel 74 which couples the reservoir tank 64 and the main tank 66.

When the filling pump 84 is operated in the ink filling and in the ink circulation, the air or the ink flows into the main tank 66, the main tank 66 is pressurized, the ink in the main tank 66 flows into the ink channel 76, and the ink flows into the reservoir tank 64 through the recording head 32 and the ink channel 68. The ink flows into the main tank 66 through the return channel 74, when the liquid surface of the ink flowing into the reservoir tank 64 reaches the ink inlet port 72 of the pipe 71.

Thus, when the filling pump 84 is provided in the return channel 74 which couples the reservoir tank 64 and the main tank 66, the main tank 66 molded by a flexible member can be used because the negative pressure is not generated in the main tank 66 during the operation of the filling pump 84.

An inkjet recording apparatus according to a third exemplary embodiment of the invention will be described below. The description of the same component as the first exemplary embodiment will be omitted.

Figure 11:
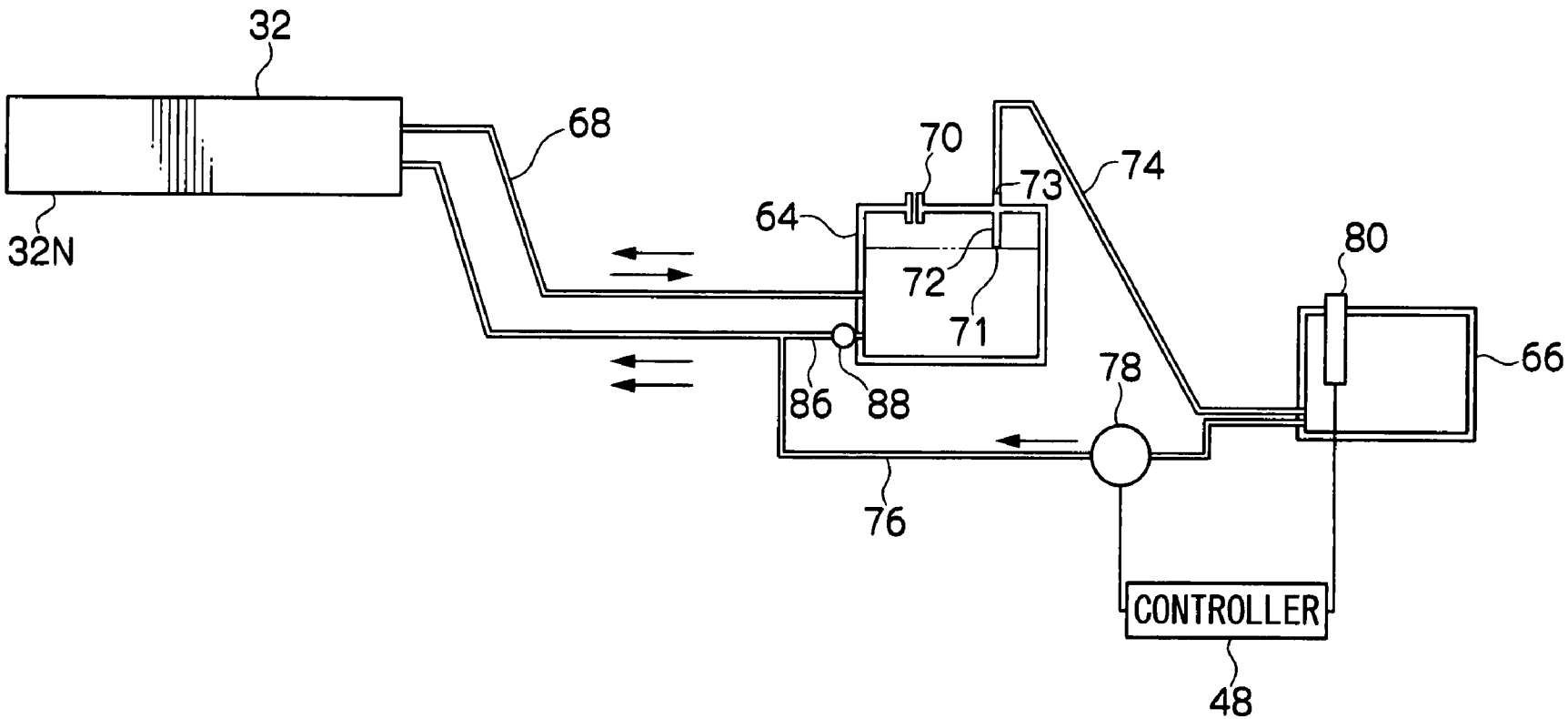
FIG. 11 is a side view showing a positional relationship among the main tank, the reservoir tank, and the recording head of an inkjet recording apparatus according to a third exemplary embodiment.

As shown in FIG. 11, the ink channel 76 and the reservoir tank 64 are coupled to each other with a connecting channel 86.

Figure 12:
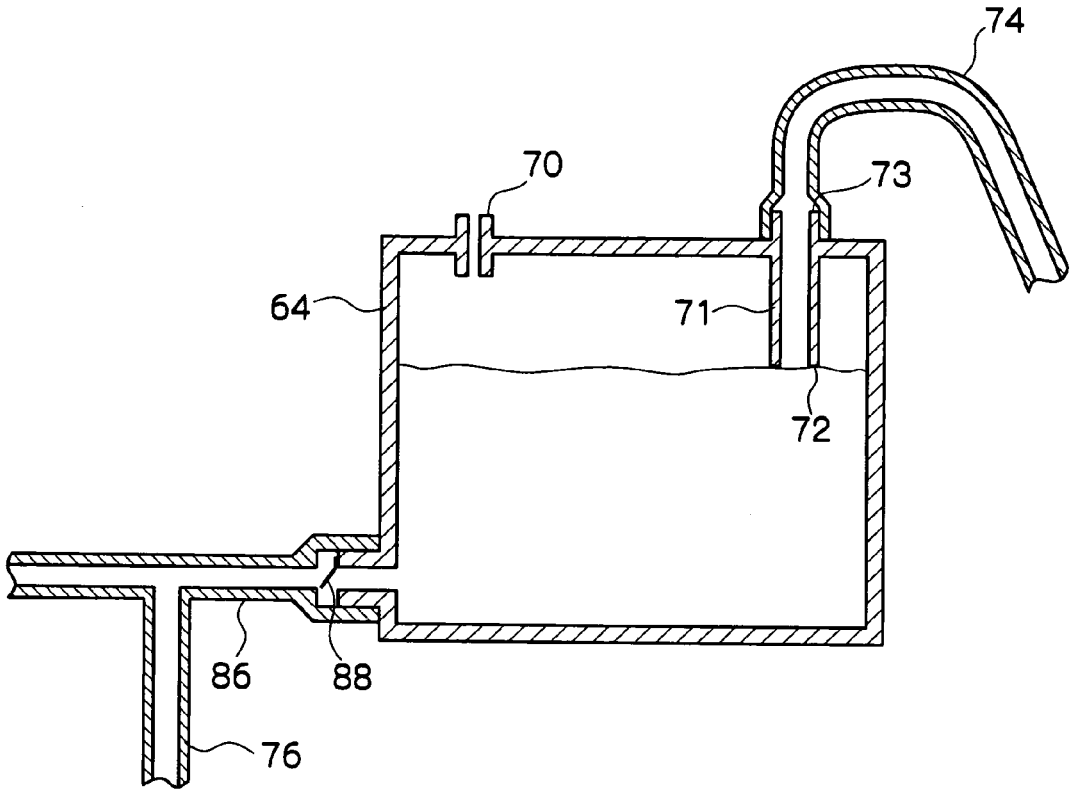
FIG. 12 is a sectional side view of the reservoir tank.
Figure 12:
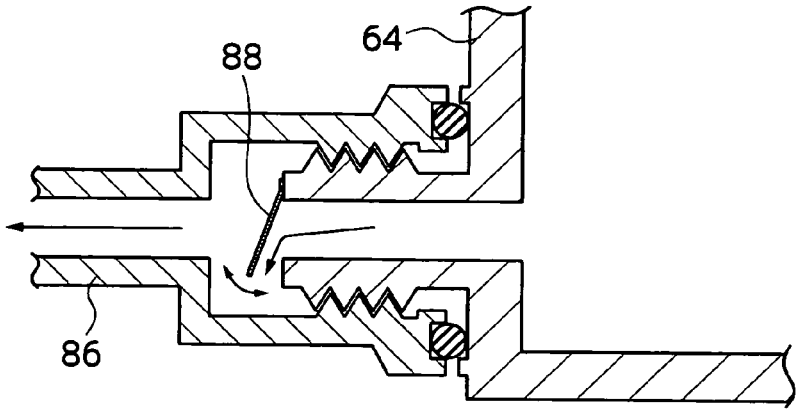

As shown in FIG. 12, a check valve 88 is provided in a connecting port of the connecting channel 86. Not only the check valve 88 enables the ink to flow into the connecting channel 86 from the reservoir tank 64, but also the check valve 88 causes the ink not to flow into the reservoir tank 64 from the connecting channel 86.

When the filling pump 78 is operated in the ink filling and in the ink circulation, the ink in the main tank 66 flows into the reservoir tank 64 through the ink channel 76, the recording head 32, and the ink channel 68. The ink flows into the main tank 66 through the return channel 74, when the liquid surface of the ink flowing into the reservoir tank 64 reaches the ink inlet port 72 of the pipe 71.

On the other hand, when the ink is discharged from the nozzle of the recording head 32, the negative pressure is generated in the recording head 32, and the ink in the reservoir tank 64 is supplied to the recording head 32 through the ink channel 68. Because the ink flows in the direction in which the check valve 88 provided in the connecting port of the connecting channel 86 is opened, the ink in the reservoir tank 64 flows into the ink channel 76 from the connecting channel 86, and the ink is supplied to the recording head 32.

The operation of the filling pump 78 is stopped in discharging the ink, so that the ink does not flow into the recording head 32 from the main tank 66 through the ink channel 76.

Thus, because the ink in the reservoir tank 64 is supplied to the recording head 32 through the two ink channels 68 and 76, pressure loss generated in the ink channels 68 and 76 during the discharge of the ink can be decreased to hardly generate the defective print caused by shortage of ink supply.

An inkjet recording apparatus according to a fourth exemplary embodiment of the invention will be described below. The description of the same component as the first exemplary embodiment will be omitted.

Figure 13:
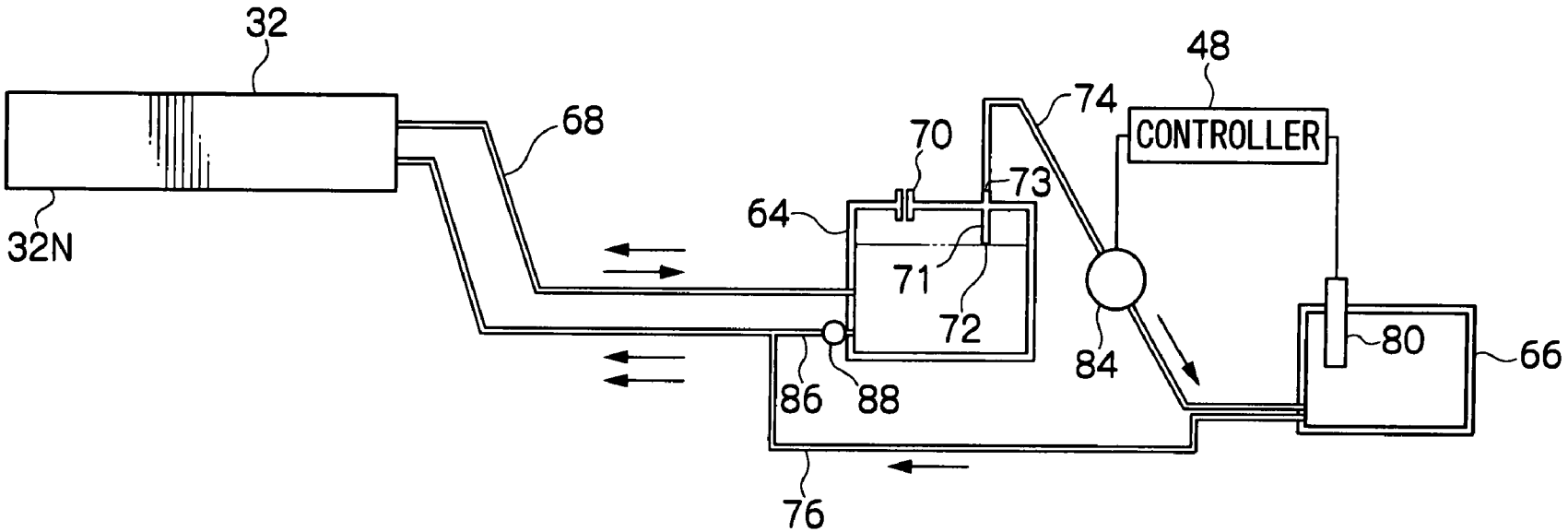
FIG. 13 is a side view showing a positional relationship among the main tank, the reservoir tank, and the recording head of an inkjet recording apparatus according to a fourth exemplary embodiment.

As shown in FIG. 13, the filling pump 84 is provided in the return channel 74 which couples the reservoir tank 64 and the main tank 66.

When the filling pump 84 is operated in the ink filling and in the ink circulation, the air or the ink flows into the main tank 66, the main tank 66 is pressurized, the ink in the main tank 66 flows into the ink channel 76, and the ink flows into the reservoir tank 64 through the recording head 32 and the ink channel 68. The ink flows into the main tank 66 through the return channel 74, when the liquid surface of the ink flowing into the reservoir tank 64 reaches the ink inlet port 72 of the pipe 71.

Thus, when the filling pump 84 is provided in the return channel 74 which couples the reservoir tank 64 and the main tank 66, the main tank 66 molded by the flexible member can be used because the negative pressure is not generated in the main tank 66 during the operation of the filling pump 84.

On the other hand, when the ink is discharged from the nozzle of the recording head 32, the negative pressure is generated in the recording head 32, and the ink in the reservoir tank 64 is supplied to the recording head 32 through the ink channel 68. The check valve 88 provided in the connecting port of the connecting channel 86 is opened, the ink in the reservoir tank 64 flows into the ink channel 76 from the connecting channel 86, and the ink is supplied to the recording head 32.

Therefore, because the ink in the reservoir tank 64 is supplied to the recording head 32 through the two ink channels 68 and 76, the pressure loss generated in the ink channels 68 and 76 during the discharge of the ink can be decreased to hardly generate the defective print caused by the shortage of ink supply.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet discharge apparatus comprising:

a droplet discharge head that discharges droplets;

a liquid retention unit that is provided below the droplet discharge head, the liquid retention unit including an atmosphere open port;

a liquid channel that couples the droplet discharge head and the liquid retention unit;

a liquid tank that retains liquid therein, the liquid tank being sealed;

a liquid inflow channel that couples the liquid retention unit and the liquid tank, an inflow port of the liquid inflow channel in the liquid retention unit being located below the atmosphere open port;

a liquid sending channel that couples the liquid tank and the droplet discharge head; and a pump that is provided at the liquid sending channel, the pump sending the liquid in the liquid tank to the droplet discharge head.

2. A droplet discharge apparatus according to claim 1, wherein a liquid level detector that detects a liquid surface level is provided in the liquid tank, and the pump is driven based on a signal from the liquid level detector.

3. A droplet discharge apparatus according to claim 1, further comprising:

a liquid flow channel that couples the liquid sending channel and the liquid retention unit; and a one-way valve that permits the liquid to flow only in one direction from the liquid retention unit to the liquid sending channel.

4. A droplet discharge apparatus according to claim 1, wherein the atmosphere open port is formed in the top wall of the liquid retention unit.

5. A droplet discharge apparatus according to claim 1, wherein a liquid surface of the liquid retained in the liquid retention unit is maintained to be below the droplet discharge head.

6. A droplet discharge apparatus comprising:

a droplet discharge head that discharges droplets;

a liquid retention unit that is configured such that a liquid surface of a liquid retained in the liquid retention unit is below the droplet discharge head, the liquid retention unit including an atmosphere open port;

a liquid channel that couples the droplet discharge head and the liquid retention unit;

a liquid tank that retains liquid therein, the liquid tank being sealed;

a liquid inflow channel that couples the liquid retention unit and the liquid tank, an inflow port of the liquid inflow channel in the liquid retention unit being below the atmosphere open port;

a liquid sending channel that couples the liquid tank and the droplet discharge head; and a pump that is provided in one of the liquid sending channel and the liquid channel, the pump causing sending the liquid in the liquid tank to be sent to the droplet discharge head.

7. A droplet discharge apparatus according to claim 6, wherein a liquid level detector that detects a liquid surface level is provided in the liquid tank, and the pump is driven based on a signal from the liquid level detector.

8. A droplet discharge apparatus according to claim 6, further comprising:

a liquid flow channel that couples the liquid sending channel and the liquid retention unit; and a one-way valve that permits the liquid to flow only in one direction from the liquid retention unit to the liquid sending channel.

9. A droplet discharge apparatus according to claim 6, wherein the atmosphere open port is formed in the top wall of the liquid retention unit.

* * * * *